United States Patent [19]

Meister et al.

[11] 4,257,113

[45] Mar. 17, 1981

[54] ELECTROMECHANICAL CALENDAR TIMEPIECE

[75] Inventors: René Meister, Neuchâtel; Claude Laesser, La Chaux-de-Fonds, both of Switzerland

[73] Assignee: Ebauches S.A., Neuchatel, Switzerland

[21] Appl. No.: 134,670

[22] Filed: Mar. 27, 1980

[30] Foreign Application Priority Data

Apr. 4, 1979 [CH] Switzerland ..... 3107/79

[51] Int. Cl.[3] ..... G04B 19/247; G04C 9/08

[52] U.S. Cl. ..... 368/35; 368/38; 368/188

[58] Field of Search ..... 368/35–38, 368/188, 202

[56] References Cited

U.S. PATENT DOCUMENTS 4,188,774 2/1980 Besson ..... 368/38

FOREIGN PATENT DOCUMENTS 566041 8/1975 Switzerland ..... 368/37

*Primary Examiner*—Edith S. Jackmon

*Attorney, Agent, or Firm*—Silverman, Cass & Singer, Ltd.

[57] ABSTRACT

An electromechanical calendar timepiece has a date display provided by two indicators carrying the "units" and tens data, respectively. The motor which drives these indicators can rotate at a normal speed or at a considerably higher speed. The units data comprise two consecutive figures "1" intended to display, respectively, the unit of the thirty-first of the months having thirty-one days and the first of each month, and one or the other of which displays the units of the eleventh and twenty-first of each month. The motor rotates at said higher speed on the one hand at the end of the months having less than thirty-one days and on the other hand twice each month, i.e. each time the "1" of the units data is displayed at the beginning of the second and the third decades.

10 Claims, 8 Drawing Figures

ELECTROMECHANICAL CALENDAR TIMEPIECE

BACKGROUND OF THE INVENTION (a) Field of the Invention

This invention relates to an electromechanical calendar timepiece with a date display device which comprises two rotatable indicator members, one of which carries at least a set of data of the units and the other one at least a set of data of the tens, the latter being driven by the first one, and which comprises a motor driving a gearing through which are driven time indicators as well as the units indicator of the data display device, the control circuit of the said motor providing for operation of the latter at two different speeds.

(b) Description of the Prior Art

Such timepieces are known per se. They are disclosed for instance in U.S. patent application Ser. No. 838,049, now U.S. Pat. No. 4,188,774 filed on Sept. 30, 1977 and commonly assigned, and in the corresponding German patent application No. 27 44 798, filed on Oct. 3, 1977 and published on Apr. 6, 1978.

In such timepieces, the control circuit of the motor is arranged in such manner as to produce a rapid advance of all the indicating members corresponding to twenty-four hours of the hours indicator while not altering the indication of the hours, of the minutes and of the seconds, at the end of each month of thirty days, so that the undesired display of the "31" and may be of the "29" at the end of the months of February in the non bissextile years, which is also undesired, appears but briefly.

SUMMARY OF THE INVENTION

The object of the present invention, which uses this particularity of operation of the above mentioned timepieces, is to improve the display of the date. This object is achieved by means as claimed in the appended claims.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
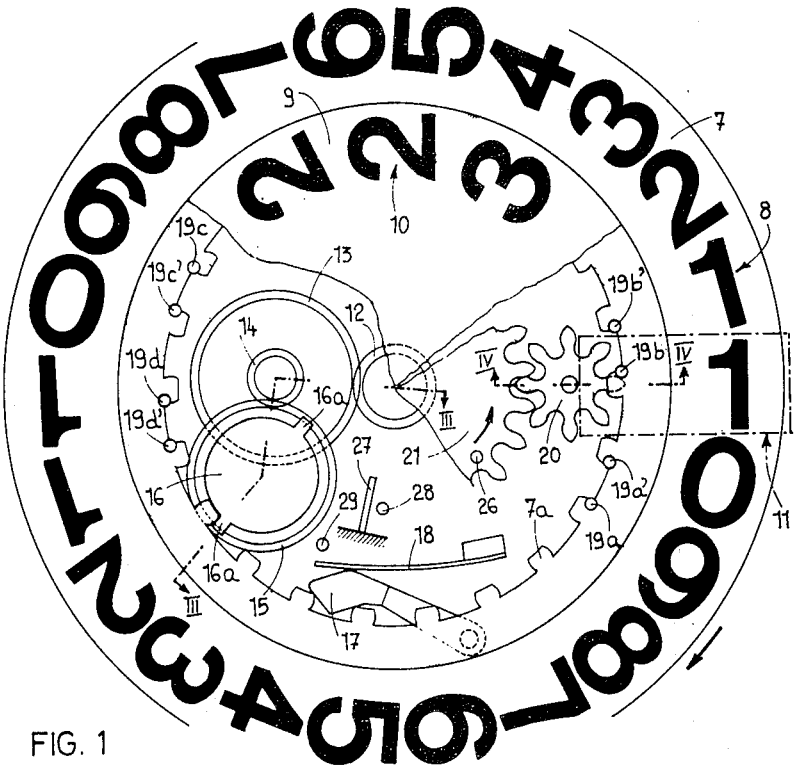
FIG. 1 is a plan view, with portions cut away, of a first embodiment of the invention in the form of an electromechanical watch having a date indicator.

The watch illustrated in FIGS. 1 to 4 comprises an hour-wheel 1, having a cannon, carrying an hour-hand 2, a cannon-pinion 3 carrying a minute-hand 4 and a seconds-wheel 5 carrying a seconds-hand 6. These several elements, namely the hour-wheel 1, cannon-pinion 3 and seconds-wheel 5 are driven by a motor M, shown diagrammatically and only in FIG. 5. The step-down gearing mechanism interposed between these several elements so that they rotate at the correct relative speeds for the hands 2, 4 and 6 to indicate the hours, the minutes and the seconds, respectively, has not been shown as it is very conventional and the present invention is not concerned therewith. The control means of the motor M will be described later.

Figure 2:
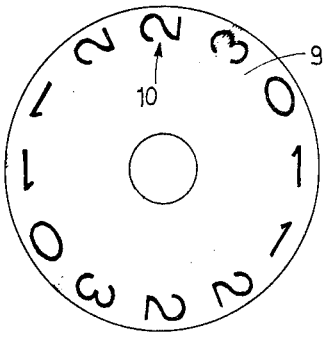
FIG. 2 is a plan view of a detail, to a smaller scale.

The watch as described and illustrated is a calendar watch and comprises a date display device having two coaxial indicators one of which, the outer one, is constituted by a crown 7 carrying two sets 8 of "units" data, and the other or inner of which is constituted by a disc 9 carrying two sets 10 of "tens" data. Each set of units data 8 carried by the crown 7 has this particularity, that it includes two consecutive data "1". Each set 10 of the tens data carried by the disc 9 comprises two consecutive data "1" and two consecutive data "2", the data of each tens set being indicated in the order "0-1-1-2-2-3" such as shown in FIG. 2. The relative positions of the two indicators are such that, when the units indicator 7 displays "0", the tens indicator 9 displays the first "1", the first "2" or the "3". In practice, the "0" of the tens indicator will not actually be shown as such but replaced by a blank white area. The indicated date, provided by the combination of the indications furnished by the units indicator 7 and by the tens indicator 9 is visible through a window provided in the watch dial, not shown, such as the window 11 indicated in dot-and-dash lines in FIG. 1. So as to ensure that the units indicator 7 is driven, the pipe 1*a* of the hour-wheel 1 carries a supplementary pinion 12, which is forced thereon (FIG. 3) and meshes with the wheel 13 of an intermediary element the pinion of which, designated by 14, meshes with a wheel 15. The gearing ratio is such that, with the hour-wheel 1 making one revolution in twelve hours, the wheel 15 makes one revolution in forty-eight hours.

The wheel 15 is rigidly connected with a control disc 16 provided with two diametrically opposed fingers 16*a* cooperating alternatively, at each half revolution, with an inner toothing 7*a* of the units indicator 7. This toothing 7*a* has twenty-two teeth, which number corresponds to the number of the units data carried by the indicator 7. Thus, once during each twenty-four hours, the indicator 7 advances one step, without mentioning the rapid advances produced by the control motor and about which there will be mention later in this description.

A jumper 17, subject to the action of a return spring 18, ensures the accurate indexing of the different positions of the units indicator 7.

The indicator 7 carries two sets of two pairs of pins 19*a*–19*a*′ and 19*b*–19*b*′ on the one hand, 19*c*–19*c*′ and 19*d*–19*d*′ on the other hand. The pins of each pair are arranged on the opposing sides of two adjacent teeth, the pins 19*a*′ and 19*b* on the one hand, 19*d* and 19*c*′ on the other hand being respectively on two adjacent teeth. The pairs 19*a*–19*a*′ and 19*b*–19*b*′ are diametrically opposed to the pairs 19c–19c' and 19d–19d', respectively. These eight pins cooperate with an intermediate pinion 20 meshing with a wheel 21 rigidly connected with the tens indicator disc 9. Each passage of one pair of pins opposite the pinion 20 causes this pinion to advance two teeth, which corresponds to an advance of one step of the tens indicator 9. thus, each complete revolution of the units indicator 7 corresponds to four steps of the tens indicator 9.

The positions of the pins on the indicator 7 are such that at each advance of the latter causing the display to pass from "9" to "0", as well as at each advance causing the display to pass from the first to the adjacent second "1", the tens indicator advances one step.

Figure 4:
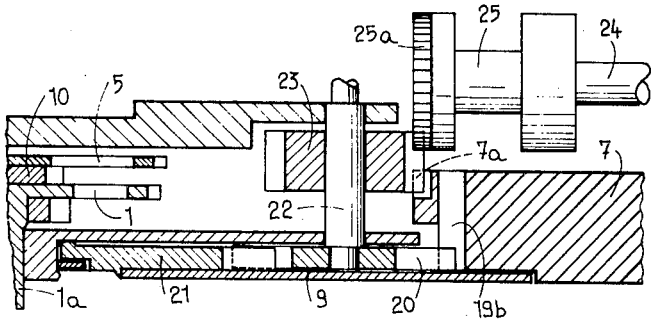
FIG. 4 is a sectional view on the line IV—IV of FIG. 1, also to a larger scale.

The pinion 20 is rigidly mounted on a shaft 22 on which is forced a pinion 23 (FIG. 4). The latter cooperates, in one axial operative position of a manually-operable control stem, designated 24, with the contrate toothing 25a of a sliding pinion 25. That provides for manual resetting of the date shown by the date indicators 7 and 9.

For reasons which will be indicated later, the wheel 21 which is rigidly connected with the tens indicator 9 carries a pin 26 (FIG. 1) while the frame of the watch carries a stationary resilient blade 27, a pin 28 situated opposite the blade 27 and a pin 29 situated opposite the end of the return spring 18 of the jumper 17.

The control circuit of the motor M is of the same type as that disclosed in the U.S. patent application Ser. No. 838,049 as well as in the corresponding German patent application No. 27 44 798, previously mentioned. Such a circuit enables the motor to rotate at a speed very much higher than its normal running speed, when necessary.

Figure 5:
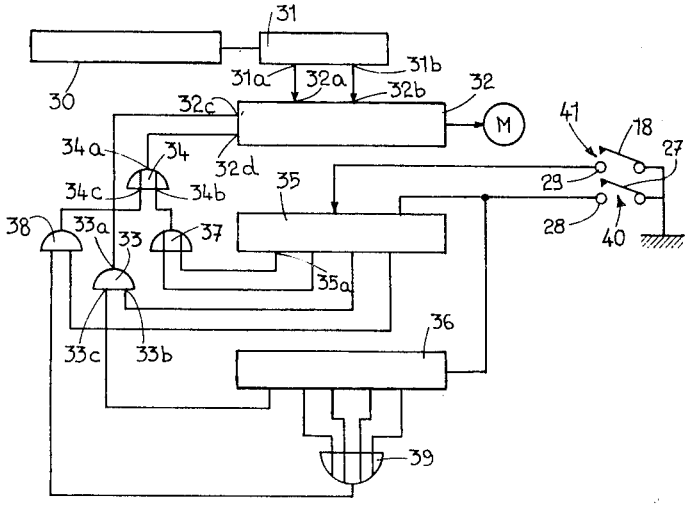
FIG. 5 is a block circuit diagram of the watch.

This circuit, diagrammatically represented in FIG. 5, comprises a time-base 30 comprising a quartz crystal oscillating for instance at a frequency of 32 kHz. This time-base feeds a divider 31 operative to reduce the frequency and which provides two outputs 31a and 31b, the first one of which is at a frequency of 64 Hz and the second one at a frequency of 1 Hz. These two outputs are connected to inputs 32a and 32b, respectively, of a control circuit, designated 32, of the motor M. The respective output signals are used to produce either a rapid speed of the motor, or a slower speed corresponding to a normal advance rate of all the indicators of the watch.

The control circuit 32 comprises, moreover, the two already mentioned inputs 32a and 32b and two inputs 32c and 32d connected, respectively, to the output 33a of an AND gate 33 and to the output 34a of an OR gate 34. The AND gate 33 has its two inputs 33b and 33c, respectively, connected to a days counter 35 having a capacity of 33 and to a months counter 36. The OR gate 34 has its input 34b connected to the output of an OR gate 37 the inputs of which are moreover connected to the days counter 35, and the input 34c connected to the output of an AND gate 38, which has an input connected to the days counter 35 and its other input connected to the months counter 36 through the intermediary of an OR gate 39. The circuit shown moreover comprises two switches 40 and 41, the first of which is constituted by the blade 27 and the pin 28 previously mentioned and the other one by the blade 18 and the pin 29 also previously mentioned. The blades 18 and 27 are electrically connected to the base plate of the watch electrical "earth". The pin 28 is connected, on the one hand, to the resetting to zero input (reset) of the days counter 35 and, on the other hand, to the input of the months counter 36. The pin 29 is connected to the input of the days counter 35.

The operation of the watch as described and illustrated is as follows:

As already mentioned, at each advance of the units indicator 7 which causes the display to pass from "9" to "0", as well as at each advance causing the display to pass from the first "1" to the second "1", the tens indicator 9 advances by one step, driven by the pins 19a–19a' and 19b–19b' (or 19c–19c' and 19d–19d'), respectively. Hence, it is either the first or the second "1" or "2" of the tens indicator 9 which is visible and serves for the display, the user not having to give his attention thereto. For instance, considering the tenth and the eleventh of one month, it is the first "1" of the tens which serves for the display and, on the twelfth, it is the second one, since, in the meantime, as it will appear later, the circuit 32 has caused the units indicator to pass rapidly from its first "1" to the second "1", during which passage there is effected an advance of the tens indicator. It is the same for the twentieth, the twenty-first and the twenty-second, so far as the data "2" of each set 10 of the tens is concerned.

But, the thirties, on the other hand, one has only one "3" amongst the tens, and it is this "3" which serves for the display of the thirtieth and of the thirty-first, as hereabove. The second "1" of the data 8 of the units indicator 7 serves to display the first of the next month, and the tens pass to "0", so that the cycle starts again.

It is the same at the end of the months of thirty days or of the month of February of the non-bissextile years, with the sole difference that, respectively, the thirty-first or the twenty-ninth, thirtieth and thirty-first are displayed very briefly, the motor M rotating then at high speed to provide a rotation of the hour-hand corresponding to twenty-four hours or a multiple of twenty-four hours.

This is achieved by the presence, at the input 32d of the control circuit 32 of the motor M, of a signal which rotates this motor at high speed for a number of steps corresponding to twenty-four hours. This input 32d is used not only for correcting the dates at the end of the months of April, June, September and November, but also the eleventh and twenty-first of each month. As a matter of fact, when the two date indicators 7 and 9 display "11", formed with the first "1" of the tens indicator disc 9 and with the first "1" of the units indicator crown 7, the output designated 35a of the days counter 35 is at a logic state 1, in such a way that the output of the OR gate 37 and, consequently, also the output of the OR gate 34, are at the logic state 1. A signal is thus applied to the input 32d of the control circuit 32 of the motor, rotating the latter at high speed. The hands then make a rotation corresponding to twenty-four hours, after which the date indicators 7–9 both display their second "1".

A similar procedure occurs when the tens date indicator 9 displays the first "2" and the units indicator 7 displays the first "1".

For the months of thirty days, when the months counter 36 corresponds to one of the above mentioned states, and when the days counter 35 is at the logic state 1, that is to say corresponding to the first of the month, the two inputs of the AND gate 38 are at the logic state 1 in such a way that this gate output is also at the logic state 1. The input 32d of the control circuit 32 of the motor is thus also at the logic state 1, which has the effect of advancing by one day the several display members of the watch.

When the months counter 36 is at "February", it applies the logic state 1 to the input 33c of the AND gate 33, the other input 33b of which is also placed in the logic state 1 by the days counter 35 when the latter occupies the states 29, 30 and 31. Thus, at the end of the month of February of the non bissextile years, the AND gate 33 successively applies to the input 32c of the circuit 32 three logic signals which advance the motor three times at a rapid speed for a period corresponding to twenty-four hours.

The contact 41 previously mentioned is controlled by the date units indicator crown 7. Each time one tooth 7a of the inner toothing of this crown lifts the jumper 17, the spring blade 18 which returns this jumper is brought into contact with the pin 29, normally insulated from the earth of the watch, which connects this pin 29 to earth and adds one unit to the days counter 35.

The contact 40 is closed when the pin 26, carried by the wheel 21 rigidly connected with the tens indicator 9, displaces the blade 27 and brings it into contact with the pin 28 which is also insulated from the earth of the watch. This closing of the contact 40 happens when the tens disc 9 passes from "3" to "0" and has the effect on the one hand of resetting the days counter to zero and, on the other hand, of adding one unit to the months counter 36.

It is to be noted that, if a correction is necessary, after changing the battery, for instance, the user pulls the stem 24 to bring it to the axial position in which the sliding pinion 25 has its toothing 25a meshing with the correcting pinion 23 rigidly connected with the pinion 20. By rotating the stem 24, the user causes the pinion 20 to rotate and this drives the units crown 7 of the date indicators. The user brings this crown into a position such that, by a back and forth relative movement of the stem 24, he can cause the dates indicators to pass from the thirty-first to the first, and inversely, a number of times corresponding to the number of the months. Thus, if, for instance, the user changes the battery in the month of October, that is to say during the tenth month of the year, he must effect ten back and forth movements between the thirty-first and the first. At each jump of the thirty-first to the first, the stud 26 deforms the blade 27 and applies it against the pin 28, which closes the contact 40 and has the effect of adding one unit of the months counter 36. Simultaneously, the days counter 35 is reset to zero. The user then brings the units and tens indicators 7 and 9 to the day corresponding to the current month. At each jump, the contact 41 is closed, the blade 18 coming into contact with the pin 29, which has the effect of adding each time one unit to the days counter 35. Since this counter has been reset to zero previously, its state corresponds finally to the state displayed by the date indicators 7–9 during the correction. The watch is then ready for use in normal conditions of operation.

Figure 7:
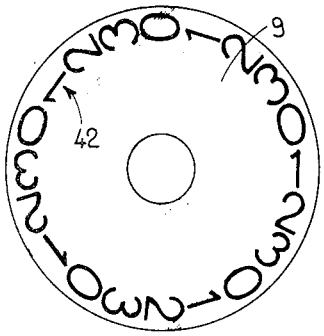
FIG. 7 is a plan view of a detail, to a smaller scale.
Figure 3:
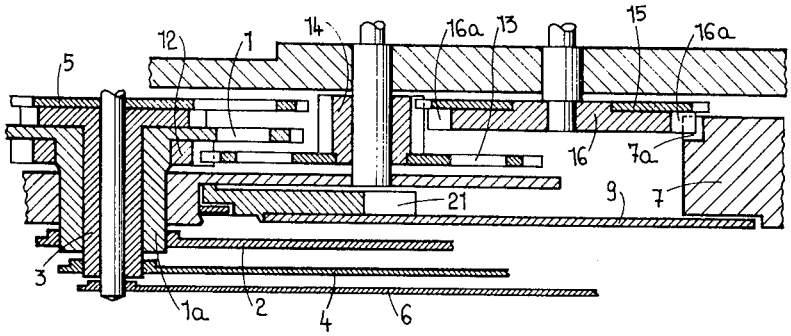
FIG. 3 is a sectional view on the line III—III of FIG. 1, to a larger scale.
Figure 6:
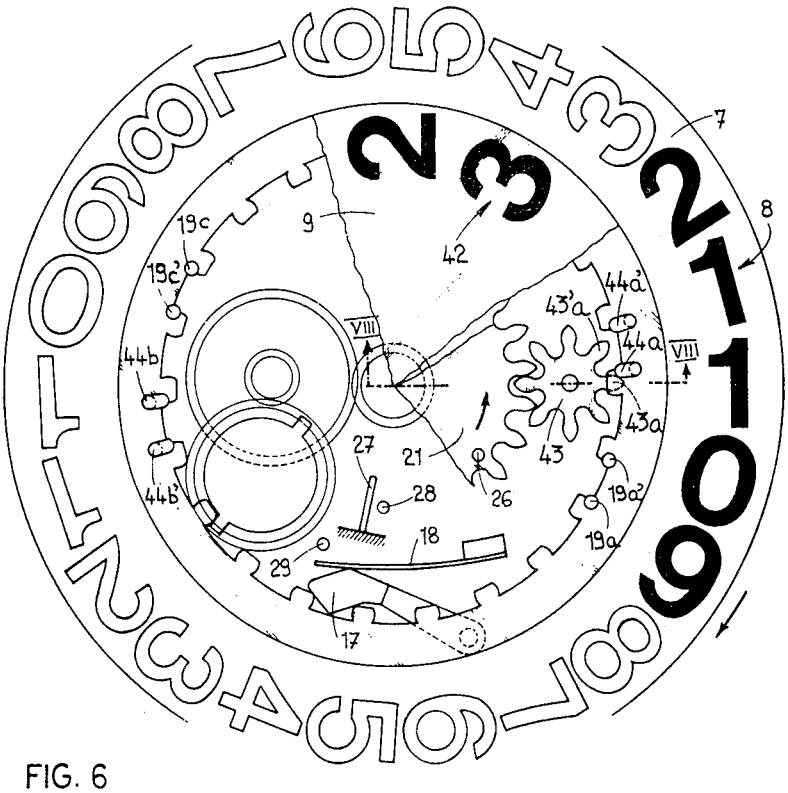
FIG. 6 is a plan view, with portions cut away, of a second embodiment of electromechanical calendar watch.
Figure 8:
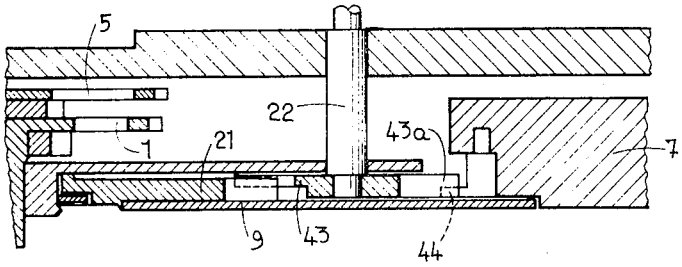
FIG. 8 is a sectional view on the line VIII—VIII of FIG. 6.

In the description of the second embodiment of FIGS. 6, 7 and 8 which follows, the elements which are identical to those of the first embodiment have been designated by the same reference numerals. This second embodiment distinguishes from the first one by the fact that the data, designated 42, of the tens indicator 9 constitute five sets of four data going from "0" to "3" in increasing order. The intermediate pinion 20 of the first embodiment is here replaced by an intermediate pinion 43, thinner than the pinion 20, but which is however provided with two teeth, designated 43a and 43'a, the thickness of which corresponds to the thickness of the pinion 20 of the first embodiment. The crown 7 indicating the date units carries the pair of pins 19a–19a' and 19c–19c' as in the first embodiment, but the pairs of pins 19b–19b' and 19d–19d' are replaced by radial fingers 44a–44a' and 44b–44b', respectively, which pass under the thin portion of the pinion 43, without engaging with the latter, and which mesh only with the thick teeth 43a and 43'a of this pinion.

As a result of this arrangement, when one of the data "1" of the graduation 8 of the units indicator 7 passes rapidly, driven by the motor M rotating at high speed, at the tenth and the twentieth of each month, the tens indicator does not advance, due to the fact that, in this case, the fingers 44 pass under the pinion 43 without driving it. On the other hand, during the passage from the first "1" of the units to the second "1", at the thirty-first of the month only, the fingers 44 cooperate with the teeth 43a and 43'a of the pinion 43 to advance it by two steps, which corresponds, as in the first embodiment, to an advance of one step of the tens indicator 9. As a matter of fact, it is once each month that the pinion 43 comes into a position (represented in FIG. 6) such that the fingers 44 can be effective. To this end, the pinion 43 must make one revolution each month, which is effected by means of four advances each month of $\frac{1}{4}$ of a revolution each. Consequently, the number of teeth on this pinion must be eight, six of which teeth are at the level of the driving pin 19 and the other two of which are at the level of the driving fingers 44.

Thus, in the two embodiments, at the end of the months of thirty-one days, the display of the thirty-first is ensured by a "3" of the tens indicator 9 and by the first "1" of the units indicator 7. Then, at the passage to the first of the next month, the two indicators rotate, the one relating to the tens displaying the "0" (white area) and that relating to the units displaying a second "1". Thus, at the end of the months of thirty-one days, everything occurs as for the other days of the month, without interrupting continuity of the mode of operation of the indicators.

At the end of the months of thirty days, the thirtieth is displayed by a "3" of the tens indicator 9 and by a "0" of the units indicator 7. The thirty-first is displayed only briefly, by a rapid driving of the motor, as described hereabove, and the first of the next month is displayed by the adjacent second "1" of the units indicator 7 and by the "0" (white area) of the tens indicator.

We claim:

1. An electromechanical calendar timepiece comprising:

means for generating time-base pulses;

a frequency divider circuit connected to receive said time-base pulses;

a motor;

a gear train driven by the motor;

time display elements driven by said gear train;

a date display system comprising a first rotatable indicating member driven stepwise by the gear train and carrying at least one set of numerals for displaying the units of the date, with two consecutive "1" for displaying respectively the "1" of the 31st and the "1" of the 1st, and a second rotatable indicating member driven stepwise by the first indicating member and carrying at least one set of numerals for displaying the tens of the date;

means for producing a first signal at the end of the months of thirty days;

means for producing a second signal when the units indicating member displays its first "1" at the beginning of the second and third decades of the month; and control means coupled with said frequency divider for normally driving said motor at a normal speed and responsive to said first and second signals for driving the motor at a speed substantially higher than said normal speed for a number or revolutions corresponding to one day.

2. The timepiece of claim 1, further comprising means for producing a third signal at the end of the month of February of the non-bissextile years, said control circuit being further responsive to said third signal for driving the motor at said higher speed for a number of revolutions corresponding to three days.

3. The timepiece of claim 1, wherein the set of numerals carried by the tens indicating member has two consecutive "1" and two consecutive "2" but only one "0" and only one "3", indicated in the order "0-1-1-2-2-3", the tens indicating member being driven by one step to display the next numeral at each step of the units indicating member causing the units display to pass from "9" to "0" and from the first "1" to the second "1".

4. The timepiece of claim 3, wherein the units indicating member carries a first driving device for driving said tens indicating member by one step to display the next numeral when the units indicating member passes from "9" to "0", and a second driving device for driving the tens indicating member by one step to display the next numeral when the unit indicating member passes from the first "1" to the second "1".

5. The timepiece of claim 4, wherein each of said driving devices comprises a pair of driving members carried by the units indicating member and cooperating with an intermediate pinion meshing with a wheel carried by the tens indicating member.

6. The timepiece of claim 5, wherein said driving members are in the form of two pins mounted on said units indicating member at an angular separation corresponding to one step of the units indicating member.

7. The timepiece of claim 1, wherein the set of numerals carried by the tens indicating member is "0-1-2-3", said tens indicating member being not driven when the units indicating member is driven at said higher speed on the 10th or 11th and the 20th or 21st of each month.

8. The timepiece of claim 7, wherein the units indicating member carries a first driving device for driving said tens indicating member by one step to display the next numeral when the units indicating member passes from "9" to "0", and a second driving device for driving the tens indicating member by one step to display the next numeral when the units indicating member passes from the first "1" to the second "1", but only on the 31st of the month.

9. The timepiece of claim 8, wherein said first driving device comprises a pair of driving members carried by the units indicating member and cooperating with an intermediate pinion meshing with a wheel carried by the tens indicating member, and said second driving device comprises a pair of driving members carried by the units indicating member and cooperating, once per revolution of the intermediate pinion, with a pair of protrusions provided on said pinion.

10. The timepiece of claim 9, wherein the driving members of said first driving device are in the form of two pins mounted on the units indicating member at an angular separation corresponding to one step of the units indicating member, the driving members of said second driving device are in the form of two radial fingers mounted on the units indicating member at an angular separation corresponding to one step of the units indicating member, and said protrusions of the intermediate pinion are provided by an increased thickness of two consecutive teeth of said pinion.

* * * * *